US009847054B2

(12) United States Patent
Hwang et al.

(10) Patent No.: US 9,847,054 B2
(45) Date of Patent: Dec. 19, 2017

(54) DISPLAY DEVICE AND ELECTRONIC DEVICE INCLUDING THE SAME

(71) Applicant: Samsung Display Co., Ltd., Yongin, Gyeonggi-Do (KR)

(72) Inventors: Kyung-Ho Hwang, Hwaseong-si (KR); Sung-Un Park, Suwon-si (KR); Eun-Jung Oh, Asan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 158 days.

(21) Appl. No.: 14/806,488

(22) Filed: Jul. 22, 2015

(65) Prior Publication Data

US 2016/0225311 A1 Aug. 4, 2016

(30) Foreign Application Priority Data

Feb. 2, 2015 (KR) ..... 10-2015-0015840

(51) Int. Cl.
*G09G 3/32* (2016.01)
*G09G 3/3208* (2016.01)
*G09G 3/20* (2006.01)

(52) U.S. Cl.
CPC ..... *G09G 3/3208* (2013.01); *G09G 3/20* (2013.01); *G09G 2310/0221* (2013.01); *G09G 2310/04* (2013.01); *G09G 2330/021* (2013.01)

(58) Field of Classification Search
CPC ..... G09G 2310/0208; G09G 2310/04; G09G 3/3648; G09G 3/3696; G09G 3/3674; G09G 3/3611; G09G 3/3666; G09G 2310/0213; G09G 2330/021; G09G 3/20; G09G 3/3208; G09G 2310/0221; G02F 1/13306; G02F 1/1345; G02F 2001/133391
See application file for complete search history.

(56) References Cited

U.S. PATENT DOCUMENTS

2001/0017611 A1* 8/2001 Moriyama ..... G09G 3/36 345/100
2003/0197472 A1 10/2003 Kanauchi et al.
2004/0233226 A1 11/2004 Toriumi et al.
(Continued)

FOREIGN PATENT DOCUMENTS

KR 10-2008-0001856 A 1/2008
KR 10-2008-0020876 A 3/2008
KR 10-2009-0131844 A 12/2009

*Primary Examiner* — Hong Zhou
(74) *Attorney, Agent, or Firm* — Knobbe Martens Olson & Bear, LLP

(57) ABSTRACT

A display device and an electronic device including the same are disclosed. In one aspect, the display device includes a display panel divided into first and second regions. The display device also includes a scan driver including a plurality of first scan stages configured to sequentially provide a scan signal to the pixels in the first region, a plurality of second stages configured to sequentially provide the scan signal to the pixels in the second region, and a scan switch connected between the first and second stages. One of the first scan stages is configured to provide a scan carry signal to the scan switch, the scan switch is configured to selectively provide the scan carry signal or a scan disable signal to the second scan stages, and the scan carry signal and the scan disable signal are configured to halt the operation of the second scan stages.

18 Claims, 7 Drawing Sheets

(56) References Cited

U.S. PATENT DOCUMENTS

| | | | | |
|---|---|---|---|---|
| 2007/0040792 | A1* | 2/2007 | Kwag | G09G 3/2092 345/100 |
| 2007/0296676 | A1* | 12/2007 | Moon | G09G 3/3677 345/98 |
| 2008/0012818 | A1* | 1/2008 | Lee | G09G 3/3677 345/100 |
| 2008/0150860 | A1* | 6/2008 | Hong | G09G 3/3677 345/87 |
| 2008/0225033 | A1* | 9/2008 | Hector | G09G 3/3666 345/211 |
| 2010/0128019 | A1* | 5/2010 | Harada | G06F 3/147 345/212 |
| 2010/0141850 | A1 | 6/2010 | Itoh | |
| 2011/0228894 | A1* | 9/2011 | Wang | G11C 19/28 377/80 |

* cited by examiner

DISPLAY DEVICE AND ELECTRONIC DEVICE INCLUDING THE SAME

INCORPORATION BY REFERENCE TO ANY PRIORITY APPLICATIONS

This application claims priority under 35 USC §119 to Korean Patent Application No. 10-2015-0015840, filed on Feb. 2, 2015 in the Korean Intellectual Property Office (KIPO), the contents of which are incorporated herein in its entirety by reference.

BACKGROUND

Field

The described technology generally relates to a display device and an electronic device including the same.

Description of the Related Technology

Flat panel displays (FPDs) are widely used in electronic devices because FPDs are relatively lightweight and thin compared to legacy cathode-ray tube (CRT) displays. Examples of specific FPD technologies include liquid crystal displays (LCDs), field emission displays (FEDs), plasma display panel (PDP) devices, and organic light-emitting diode (OLED) displays. The OLED displays have been proposed as a next-generation display because their self-emissive technology has favorable characteristics such as a wide viewing angle, a rapid response speed, a thin thickness, low power consumption, etc.

An image can be displayed on a partial region of the display panel. For example, when a mobile phone is combined with a case having a window, the image can be displayed on the part of the display panel that is exposed through the window of the case.

SUMMARY OF CERTAIN INVENTIVE ASPECTS

One inventive aspect relates to a display device that can decrease power consumption when the display device is driven in a partial mode and an electronic device including the display device.

Another aspect is a display device that includes a display panel including a plurality of pixels, the display panel divided into a first region and a second region, a scan driver including first scan stages that sequentially provide a scan signal to the pixels in the first region, second stages that sequentially provide the scan signal to the pixels in the second region, and a scan switch coupled between the first stages and the second stages to selectively provide a scan carry signal provided from the first scan stages or a scan disable signal that halts an operation of the second scan stages to the second scan stages, a data driver configured to provide a data signal to the pixels, and a timing controller configured to generate a first control signal and a second control signal that controls the scan driver and the data driver, the scan switch provides the scan carry signal to the second scan stage in a first driving mode and the scan disable signal to the second scan stage in a second driving mode.

In example embodiments, the scan switch includes a first switching transistor turned on in response to the first control signal, and a second switching transistor turned on in response to the second control signal.

In example embodiments, the scan carry signal is provided to the second scan stage when the first switching transistor is turned on.

In example embodiments, the scan disable signal is provided to the second scan stage when the second switching transistor is turned on.

In example embodiments, the data driver includes at least one source amplifier configured to amplify an input signal and to output an amplified input signal as the data signal, at least one power switch configured to selectively provide a driving power or a ground power to a power terminal of the source amplifier, and a data switch configured to provide a predetermined first source power signal to the power switch in the first driving mode and a predetermined second source power signal to the power switch in the second driving mode.

In example embodiments, the data switch includes a third switching transistor turned on in response to the first control signal, and a fourth switching transistor turned on in response to the second control signal.

In example embodiments, the first source power signal having a first voltage level is provided to the power switch when the third switching transistor is turned on, and the second source power signal changed from the first voltage level to a second voltage level is provided to the power switch when the fourth switching transistor is turned on.

In example embodiments, the power switch includes a first power switching transistor configured to provide the driving power to the power terminal of the source amplifier in response to the signal having a first voltage level and a second power switching transistor configured to provide the ground power to the power terminal of the source amplifier in response to a signal having a second voltage level.

In example embodiments, the display device further includes an initial driver including first initial stages that sequentially provide an initial signal that initializes a gate voltage of a driving transistor included in the pixels to the pixels in the first region, second initial stages that sequentially provide the initial signal to the pixels in the second region, and an initial switch coupled between the first initial stages and the second initial stages to selectively provide an initial carry signal provided from the first initial stages or an initial disable signal that halts an operation of the second initial stages to the second initial stages.

In some example embodiments, the display device further includes a discharge driver including first discharge stages that sequentially provide a discharge signal to form a discharge path of an organic light emitting element included in the pixels to the pixels in the first region, second discharge stages that sequentially provide the discharge signal to the pixels in the second region, and a discharge switch coupled between the first discharge stages and the second discharge stages to selectively provide a discharge carry signal provided from the first discharge stages or a discharge disable signal that halts an operation of the second discharge stages to the second discharge stages.

Another aspect is an electronic device that includes a display device and a processor that controls the display device. The display device can include a display panel including a plurality of pixels, the display panel divided into a first region and a second region, a scan driver including first scan stages that sequentially provide a scan signal to the pixels in the first region, second scan stages that sequentially provide the scan signal to the pixels in the second region, and a scan switch coupled between the first scan stages and the second scan stages to selectively provides a scan carry signal provided from the first scan stages or a scan disable signal that halts an operation of the second scan stages to the second scan stages, a data driver configured to provide a data signal to the pixels, and a timing controller configured to generate a first control signal and a second control signal that controls the scan driver and the data driver, wherein the scan switch provides the scan carry signal to the second scan stage in a first driving mode and the scan disable signal to the second scan stage in a second driving mode.

In example embodiments, the scan switch includes a first switching transistor turned on in response to the first control signal and a second switching transistor turned on in response to the second control signal.

In example embodiments, the scan carry signal is provided to the second scan stage when the first switching transistor is turned on.

In example embodiments, the scan disable signal is provided to the second scan stage when the second switching transistor is turned on.

In example embodiments, the data driver includes at least one source amplifier configured to amplify an input signal and to output an amplified input signal as the data signal, at least one power switch configured to selectively provide a driving power or a ground power to a power terminal of the source amplifier, and a data switch configured to provide a predetermined first source power signal to the power switch in the first driving mode and a predetermined second source power signal to the power switch in the second driving mode.

In example embodiments, the data switch includes a third switching transistor turned on in response to the first control signal and a fourth switching transistor turned on in response to the second control signal.

In example embodiments, the first source power signal having a first voltage level is provided to the power switch when the third switching transistor is turned on, and the second source power signal changed from the first voltage level to a second voltage level can be provided to the power switch when the fourth switching transistor is turned on.

In example embodiments, the power switch includes a first power switching transistor configured to provide the driving power to the power terminal of the source amplifier in response to a signal having a first voltage level and a second power switching transistor configured to provide the ground power to the power terminal of the source amplifier in response to a signal having a second voltage level.

In example embodiments, the display device further includes an initial driver including first initial stages that sequentially provide an initial signal that initializes a gate voltage of a driving transistor included in the pixels to the pixels in the first region, second initial stages that sequentially provide the initial signal to the pixels in the second region, and an initial switch coupled between the first initial stages and the second initial stages to selectively provide an initial carry signal provided from the first initial stages or an initial disable signal that halts an operation of the second initial stages to the second initial stages.

In example embodiments, the display device further includes a discharge driver including first discharge stages that sequentially provide a discharge signal to form a discharge path of an organic light emitting element included in the pixels to the pixels in the first region, second discharge stages that sequentially provide the discharge signal to the pixels in the second region, and a discharge switch coupled between the first discharge stages and the second discharge stages to selectively provide a discharge carry signal provided from the first discharge stage or a discharge disable signal that halts an operation of the second discharge stage to the second discharge stages.

Another aspect is a display device comprising: a display panel including a plurality of pixels, wherein the display panel is divided into first and second regions; a scan driver including i) a plurality of first scan stages configured to sequentially provide a scan signal to the pixels in the first region, ii) a plurality of second stages configured to sequentially provide the scan signal to the pixels in the second region, and iii) a scan switch connected between the first and second stages, wherein one of the first scan stages is configured to provide a scan carry signal to the scan switch, wherein the scan switch is configured to selectively provide the scan carry signal or a scan disable signal to the second scan stages, and wherein the scan disable signal is configured to halt the operation of the second scan stages; a data driver configured to provide a data signal to the pixels; and a timing controller configured to generate first and second control signals configured to respectively control the scan driver and the data driver, wherein the scan switch is configured to provide the scan carry signal to selected one of the second scan stages in a first driving mode and the scan disable signal to the selected second scan stage in a second driving mode.

In the above display device, the scan switch includes: a first switching transistor configured to be turned on based on the first control signal; and a second switching transistor configured to be turned on based on the second control signal.

In the above display device, the scan switch is configured to provide the scan carry signal to the selected second scan stage when the first switching transistor is turned on.

In the above display device, the scan switch is configured to provide the scan disable signal to the selected second scan stage when the second switching transistor is turned on.

In the above display device, the data driver includes: at least one source amplifier configured to amplify an input signal and output the amplified input signal as the data signal, wherein the at least one source amplifier includes a power terminal; at least one power switch configured to selectively provide driving power or ground power to the power terminal of the at least one source amplifier; and a data switch configured to provide i) a predetermined first source power signal to the power switch in the first driving mode and ii) a predetermined second source power signal to the power switch in the second driving mode.

In the above display device, the data switch includes: a third switching transistor configured to be turned on based on the first control signal; and a fourth switching transistor configured to be turned on based on the second control signal.

In the above display device, the data switch is configured to provide the first source power signal having a first voltage level to the power switch when the third switching transistor is turned on, wherein the data switch is further configured to change the second source power signal from the first voltage level to a second voltage level different from the first voltage level when the fourth switching transistor is turned on.

In the above display device, the power switch includes: a first power switching transistor configured to provide the driving power to the power terminal of the source amplifier based on the first control signal having a first voltage level; and a second power switching transistor configured to provide the ground power to the power terminal of the source amplifier based on the second control signal having a second voltage level different from the first voltage level.

In the above display device, each pixel includes a driving transistor, and wherein the display device further comprises an initial driver including: a plurality of first initial stages configured to sequentially provide an initial signal to initialize a gate voltage of the driving transistor of a first pixel in the first region; a plurality of second initial stages configured to sequentially provide the initial signal to the pixels in the second region; and an initial switch connected between the first and second initial stages, wherein one of the first initial stages is configured to provide an initial carry signal to the initial switch, wherein the initial switch is configured to selectively provide the initial carry signal or an initial disable signal to the second initial stages, and wherein the initial disable signal is configured to halt the operation of the second initial stages.

In the above display device, each pixel includes an organic light-emitting element, and wherein the display device further comprises a discharge driver including; a plurality of first discharge stages configured to sequentially provide a discharge signal to form a discharge path of the organic light-emitting element of a pixel in the first region; a plurality of second discharge stages configured to sequentially provide the discharge signal to the pixels in the second region; and a discharge switch connected between the first and second discharge stages, wherein one of the first discharge stages is configured to provide a discharge carry signal to the discharge switch, wherein the discharge switch is configured to selectively provide the discharge carry signal or a discharge disable signal to the second discharge stages, and wherein the discharge disable signal is configured to halt the operation of the second discharge stages.

Another aspect is an electronic device, comprising: a display device; and a processor configured to control the display device. The display device includes: a display panel including a plurality of pixels, wherein the display panel is divided into first and second regions; a scan driver including i) a plurality of first scan stages configured to sequentially provide a scan signal to the pixels in the first region, ii) a plurality of second scan stages configured to sequentially provide the scan signal to the pixels in the second region, and iii) a scan switch connected between the first and second scan stages, wherein one of the first scan stages is configured to provide a scan carry signal to the scan switch, wherein the scan switch is configured to selectively provides the scan carry signal or a scan disable signal to the second scan stages, and wherein the scan disable signal is configured to halt the operation of the second scan stages; a data driver configured to provide a data signal to the pixels; and a timing controller configured to generate first and second control signals configured to respectively control the scan driver and the data driver, wherein the scan switch is configured to provide the scan carry signal to a selected one of the second scan stages in a first driving mode and the scan disable signal to the selected second scan stage in a second driving mode.

In the above electronic device, the scan switch includes: a first switching transistor configured to be turned on based on the first control signal; and a second switching transistor configured to be turned on based on the second control signal.

In the above electronic device, the scan switch is configured to provide the scan carry signal to the selected second scan stage when the first switching transistor is turned on.

In the above electronic device, the scan switch is configured to provide the scan disable signal to the selected second scan stage when the second switching transistor is turned on.

In the above electronic device, the data driver includes: at least one source amplifier configured to amplify an input signal and output the amplified input signal as the data signal, wherein the at least one source amplifier includes a power terminal; at least one power switch configured to selectively provide driving power or ground power to the power terminal of the at least one source amplifier; and a data switch configured to provide i) a predetermined first source power signal to the power switch in the first driving mode and ii) a predetermined second source power signal to the power switch in the second driving mode.

In the above electronic device, the data switch includes: a third switching transistor configured to be turned on based on the first control signal; and a fourth switching transistor configured to be turned on based on the second control signal.

In the above electronic device, the data switch is configured to provide the first source power signal having a first voltage level to the power switch when the third switching transistor is turned on, wherein the data switch is further configured to change the second source power signal from the first voltage level to a second voltage level different from the first voltage level when the fourth switching transistor is turned on.

In the above electronic device, the power switch includes: a first power switching transistor configured to provide the driving power to the power terminal of the source amplifier based on the first control a signal having a first voltage level; and a second power switching transistor configured to provide the ground power to the power terminal of the source amplifier based on the second control signal having a second voltage level different from the first voltage level.

In the above electronic device, the display device further includes an initial driver comprising: a plurality of first initial stages configured to sequentially provide an initial signal to initialize a gate voltage of the driving transistor of a first pixel in the first region; a plurality of second initial stages configured to sequentially provide the initial signal to the pixels in the second region; and an initial switch connected between the first and second initial stages, wherein one of the first initial stages is configured to provide an initial carry signal to the initial switch, wherein the initial switch is configured to selectively provide the initial carry signal or an initial disable signal to the second initial stages, and wherein the initial disable signal is configured to halt the operation of the second initial stages.

In the above electronic device, the display device further includes a discharge driver comprising: a plurality of first discharge stages configured to sequentially provide a discharge signal to form a discharge path of the organic light-emitting element of a pixel in the first region; a plurality of second discharge stages configured to sequentially provide the discharge signal to the pixels in the second region; and a discharge switch connected between the first and second discharge stages, wherein one of the first discharge stages is configured to provide a discharge carry signal to the discharge switch, wherein the discharge switch is configured to selectively provide the discharge carry signal or a discharge disable signal to the second discharge stages, and wherein the discharge disable signal is configured to halt the operation of the second discharge stages.

According to at least one of the disclosed embodiments, a display device and an electronic device can determine whether a second stage is driven or not by disposing a scan switch between a first scan stages that provide a scan signal to pixels in a first region of a display panel and the second stages that provide the scan signal to pixels in a second region of a display panel, and providing a scan carry signal or a scan disable signal to the second scan stage through the scan switch. Thus, the display device and the electronic device having the same can decrease power consumption when the display device is driven in a partial mode.

DETAILED DESCRIPTION OF CERTAIN INVENTIVE EMBODIMENTS

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
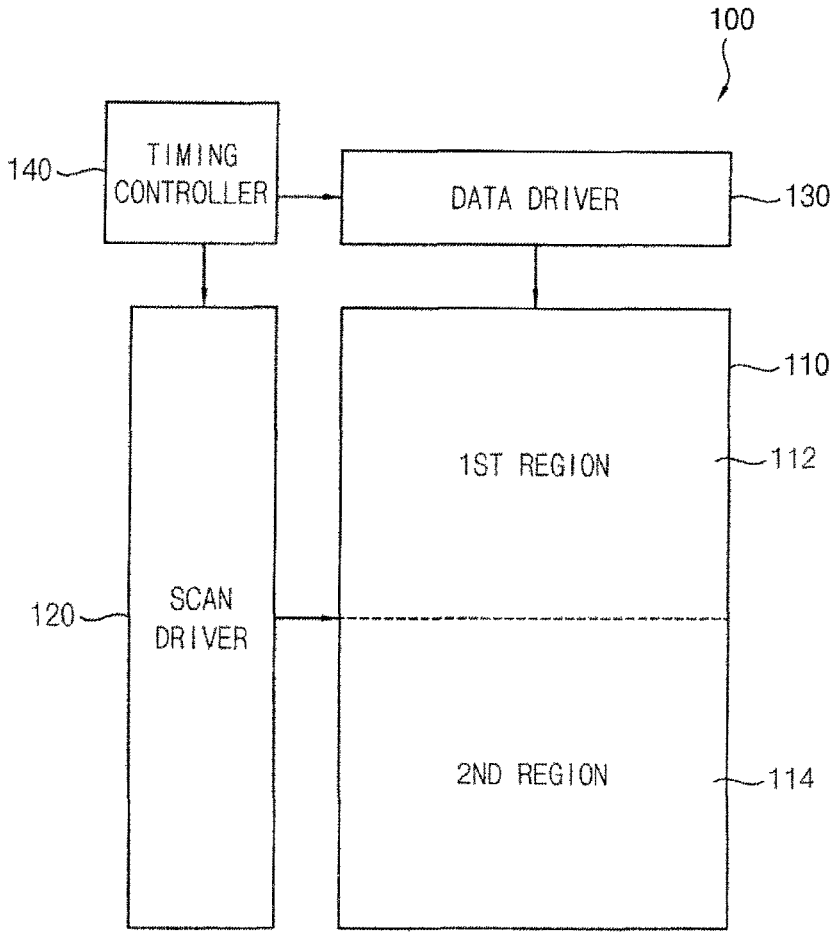
FIG. 1 is a block diagram illustrating a display device according to example embodiments.

Referring to FIG. 1, a display device 100 includes a display panel 110, a scan driver 120, a data driver 130, and a timing controller 140. Depending on embodiments, certain elements may be removed from or additional elements may be added to the display device 100 illustrated in FIG. 1. Furthermore, two or more elements may be combined into a single element, or a single element may be realized as multiple elements. This also applies to the remaining disclosed embodiments.

The display panel 110 can include a plurality of pixels. A plurality of data lines and a plurality of scan lines can be formed on the display panel 110. The pixels can be formed in an intersection region of the data lines and the scan lines. In some example embodiments, each of the pixels includes a pixel circuit, a driving transistor, and an organic light-emitting diode (OLED). In this case, the pixel circuit can control a driving current flowing through the OLED based on a data signal, where the data signal is provided via a data line in response to the scan signal, where the scan signal is provided via a scan line. The OLED can emit light based on the driving current.

The display panel 110 can be divided into a first region 112 and a second region 114. An image can be displayed on the first region 112 and the second region 114 based on a driving mode. Alternatively, the image can be displayed on the first region 112 or the second region 114 based on the driving mode. For example, the display device 100 that includes the display panel 110 is implemented as a smartphone. The image can be displayed on the first region 112 and the second region 114 in a first driving mode while a user uses the smartphone. Alternatively, the image can be displayed on the first region 112 in a second driving mode while the smartphone is combined with a case having a window. Here, the first region 112 can be a partial region of the display panel 110 that is exposed through the window of the case.

The scan driver 120 can provide the scan signal to the pixels through the scan lines. The data driver 130 can provide the data signal to the pixels through the data lines in response to the scan signal. The timing controller 140 can generate a first control signal and a second control signal that control the scan driver 120 and the data driver 130.

The scan driver 120 can provide the scan signal to the pixels in the first region 112 and the second region 114 based on the driving mode of the display device 100. Alternatively, the scan driver 120 can provide the scan signal to the pixels in the first region 112 based on the driving mode of the display device 100. The scan driver 120 can include first scan stages, second scan stages, and a scan switch. The first scan stages can sequentially provide the scan signal to the pixels in the first region 112 in response to a scan start signal provided from the timing controller 140 or the data driver 130. The second scan stages can sequentially provide the scan signal to the pixels in the second region 114 in response to a scan carry signal provided from the first scan stage. The scan switch can be coupled between the first scan stages and the second scan stages. The scan switch can determine whether to drive the second stages based on the driving mode. The scan switch can selectively provide the scan carry signal provided from the first scan stage or the scan disable signal that halts an operation of the second stage to the second stage based on the driving mode. The scan switch can include a first switching transistor turned on in response to the first control signal and a second switching transistor turned on in response to the second control signal. In some example embodiments, the first switching transistor and the second switching transistor is implemented as a PMOS (P-channel Metal Oxide Semiconductor) transistor. In other example embodiments, the first switching transistor and the second switching transistor are implemented as a NMOS (N-channel Metal Oxide Semiconductor) transistor. The first control signal can be provided to the scan switch when the display device 100 is driven in the first driving mode (e.g. the image displays on the first region 112 and the second region 114 in the first driving mode). The scan switch can provide the scan carry signal generated in the first scan stage to the second scan stage through the first switching transistor turned on in response to the first control signal. The second scan stage can sequentially provide the scan signal to the pixels in the second region 114 in response to the scan carry signal provided from the first scan stage. The second control signal can be provided to the scan switch when the display device 100 is driven in the second driving mode, that is, when the image is displayed on the first region 112. The scan switch can provide the predetermined scan disable signal to the second scan stage through the second switching transistor turned on in response to the second control signal. The scan disable signal can be a signal having a voltage level that halts the operation of the second scan stage. In some embodiments, the scan signal is not provided to the pixels in the second region 114 because the second scan stages are not driven. As described above, the scan driver 120 included in the display device 100 of FIG. 1 decreases power consumption by not providing the scan signal to a partial region of the display panel 110 on which the image is not displayed.

The data driver 130 can provide the data signal to the pixels in the first region 112 and the second region 114 based on the driving mode. Alternatively, the data driver 130 can provide the data signal to the pixels in the first region 112 based on the driving mode. The data driver 130 can include at least one source amplifier, at least one power switch, and a data switch. The data driver 130 can convert an input signal provided as a digital signal through the timing controller 140 to an analog signal and amplify the analog signal (that is, the input signal) using the source amplifier. The amplified input signal can be output as the data signal. The power switch can be coupled to a power terminal 415 of the source amplifier to determine whether or not to operate the source amplifier. The power switch can selectively provide a driving power or a ground power to the power terminal 415 of the source amplifier. The driving power can be a power signal having a voltage level that operates the source amplifier and the ground power can be a power signal having a voltage level that halts the operation of the source amplifier. The power switch can include a first power switching transistor turned on in response to a signal having a first voltage level and a second power switching transistor turned on in response to a signal having a second voltage level. In some example embodiments, the first power switching transistor is implemented as a PMOS transistor, and the second power switching transistor is implemented as a NMOS transistor. In other example embodiments, the first power switching transistor is implemented as the NMOS transistor and the second power switching transistor is implemented as the PMOS transistor. The first power switching transistor can be turned on and the driving power can be provided to the source amplifier through the first power switching transistor when the signal having the first voltage level is provided to the power switch. Thus, the source amplifier can amplify the analog signal and output the amplified analog signal as the data signal. The second power switching transistor can be turned on and the ground power can be provided to the source amplifier through the second power switching transistor when the signal having the second voltage level is provided to the power switch. Thus, in some embodiments, the source amplifier is not driven and the data signal is not output. The data switch can be coupled to the power switch. The data switch can selectively provide the first source power signal or the second source power signal to the power switch based on the driving mode. The data switch can include a third switching transistor turned on in response to the first control signal and a fourth switching transistor turned on in response to the second control signal. In some example embodiments, the third switching transistor and the fourth switching transistor are implemented as the PMOS transistor. In other example embodiments, the third switching transistor and the fourth switching transistor are implemented as the NMOS transistor. The first control signal can be provided to the data switch when the display device 100 operates in the first driving mode (e.g. the image is displayed on the first region 112 and the second region 114 in the first driving mode). The data switch can provide the predetermined first source power signal to the power switch through the third switching transistor turned on in response to the first control signal. The first source power signal can be a signal having a first voltage level. The second control signal can be provided to the data switch when the display device 100 operates in the second driving mode (e.g. the image is displayed on the first region 112 in the second driving mode). The data switch can provide the predetermined second source power signal to the power switch through the fourth switching transistor turned on in response to the second control signal. The second source power signal can be a signal changed from the first voltage level to the second voltage level. The first power switching transistor can be turned on and the driving power can be provided to the source amplifier while the second source power signal has the first voltage level. Further, the second power switching transistor can be turned on and the ground power can be provided to the source amplifier while the second source power signal has the second voltage level. Thus, in some embodiments, the data signal is provided to the pixels in the first region 112 on which the image is displayed and is not provided to the pixels in the second region 114 on which the image is not displayed. As described above, the data driver 130 included in the display device 100 can decrease the power consumption by not providing the data signal to the pixels in the region on which the image is not displayed.

The timing controller 140 can generate control signals that control the scan driver 120 and the data driver 130. For example, the timing controller 140 generates the first control signal that controls the scan switch in the scan driver 120 and the second control signal that controls the data switch in the data driver 140. The timing controller 140 can provide the first control signal to the scan driver 120 and the data driver 130 when the display device 100 is driven in the first driving mode. The timing controller 140 can provide the second control signal to the scan driver 120 and the data driver 130 when the display device 100 is driven in the second driving mode. Although the display device 100 that includes the display panel 110, the scan driver 120, the data driver 130, and the timing controller 140 is described above, the display device 100 is not limited thereto. For example, the display device 100 further includes an initial driver that provide an initial signal to the pixels and a discharge driver that provide a discharge signal to the pixels.

The initial driver can provide the initial signal that initializes a gate voltage of a driving transistor included in the pixels to the pixels. The initial transistor included in the pixels can provide an initial voltage to a gate electrode of the driving transistor in response to the initial signal. For example, the initial driver provides the initial signal to the pixels in the first region 112 and the second region 114 based on the driving mode. Alternatively, the initial driver can provide the initial signal to the pixels in the first region 112 based on the driving mode. The initial driver can include first initial stages, second initial stages, and an initial switch. The first initial stage can sequentially provide the initial signal to the pixels in the first region 112 in response to an initial start signal provided from the timing controller 140 or the data driver 130. The second initial stage can sequentially provide the initial signal to the pixels in the second region 114 in response to an initial carry signal provided from the first initial stage. The initial switch can be coupled between the first initial stages and the second initial stages. The initial switch can determine whether or not to drive the second initial stage based on the driving mode. The initial switch can selectively provide the initial carry signal provided from the first initial stage or an initial disable signal that halts the operation of the second initial stage based on the driving mode. The initial switch can include a first switching transistor turned on in response to the first control signal and a second switching transistor turned on in response to the second control signal. In some embodiments, the first and second switching transistors are implemented as the PMOS transistor. In other example embodiment, the first and second switching transistors are implemented as the NMOS transistor. The first control signal can be provided to the initial switch when the display device 100 is driven in the first driving mode (e.g. the image is displayed on the first region 112 and the second region 114 in the first driving mode). The initial switch can provide the initial carry signal generated in the first initial stage to the second initial stage through the first switching transistor turned on in response to the first control signal. The second initial stage can sequentially provide the initial signal to the pixels in the second region 114 in response to the initial carry signal. The second control signal can be provided to the initial switch when the display device 100 is driven in the second driving mode (e.g.

the image is displayed on the first region 112 in the second driving mode). The initial switch can provide the predetermined initial disable signal to the second initial stage through the second switching transistor turned on in response to the second control signal. The initial disable signal can be a signal having a voltage level that halts the operation of the second initial stage. In some embodiments, the initial signal is not provided to the pixels in the second region 114 because the second initial stages are not driven. As described above, the initial driver included in the display device 100 can decrease the power consumption by not providing the initial signal to the partial region of the display panel 110 on which the image is not displayed.

The discharge driver can provide the discharge signal that form a discharge path for discharging a capacitance formed on the OLED to the pixels. The discharge transistor included in the pixels can form the discharge path in response to the discharge signal. For example, the discharge driver provides the discharge signal to the pixels in the first region 112 and the second region 114 based on the driving mode. Alternatively, the discharge driver can provide the discharge signal to the pixels in the first region 112 based on the driving mode. The discharge driver can include first discharge stages, second discharge stages, and a discharge switch. The first discharge stages can sequentially provide the discharge signal to the pixels in the first region 112 in response to a discharge start signal provided from the timing controller 140 or the data driver 130. The second discharge stages can sequentially provide the discharge signal to the pixels in the second region 114 in response to the discharge carry signal provided from the first discharge stage. The discharge switch can be coupled between the first discharge stages and the second discharge stages. The discharge switch can determine whether to drive the second discharge stages based on the driving mode. The discharge switch can selectively provide the discharge carry signal provided from the first discharge stage or the discharge disable signal that halts the operation of the second discharge stage to the second discharge stage based on the driving mode. The discharge switch can include a first switching transistor turned on in response to the first control signal and the second switching transistor turned on in response to the second control signal. In some example embodiments, the first and second switching transistors are implemented as the PMOS transistor. In other example embodiments, the first and second switching transistors are implemented as the NMOS transistor. The first control signal can be provided to the discharge switch when the display device 100 is driven in the first driving mode (e.g. the image is displayed on the first region 112 and the second region 114 in the first driving mode). The discharge switch can provide the discharge carry signal generated in the first discharge stage to the second discharge stage through the first switching transistor tuned on in response to the first control signal. The second discharge stage can sequentially provide the discharge signal to the pixels in the second region 114 in response to the discharge carry signal provided from the first discharge stage. The second control signal can be provided to the discharge switch when the display device 100 is driven in the second driving mode (e.g. the image is displayed on the first region 112 in the second driving mode). The discharge switch can provide the predetermined discharge disable signal to the second discharge stage through the second switching transistor turned on in response to the second control signal. The discharge disable signal can be a signal having a voltage level that halts the operation of the second discharge stage. In some embodiments, the discharge signal is not provided to the pixels in the second region 114 because the second discharge stages are not driven. As described above, the discharge drive included in the display device 100 can decrease the power consumption by not providing the discharge signal to the partial region of the display panel 110 on which the image is not displayed.

As described above, the display device 100 of FIG. 1 decreases the power consumption by not providing the scan signal to the partial region on which the image is not displayed (e.g. the second region 114). Further, the display device 100 of FIG. 1 decreases the power consumption by not providing the data signal to the region on which the image is not displayed.

Figure 2:
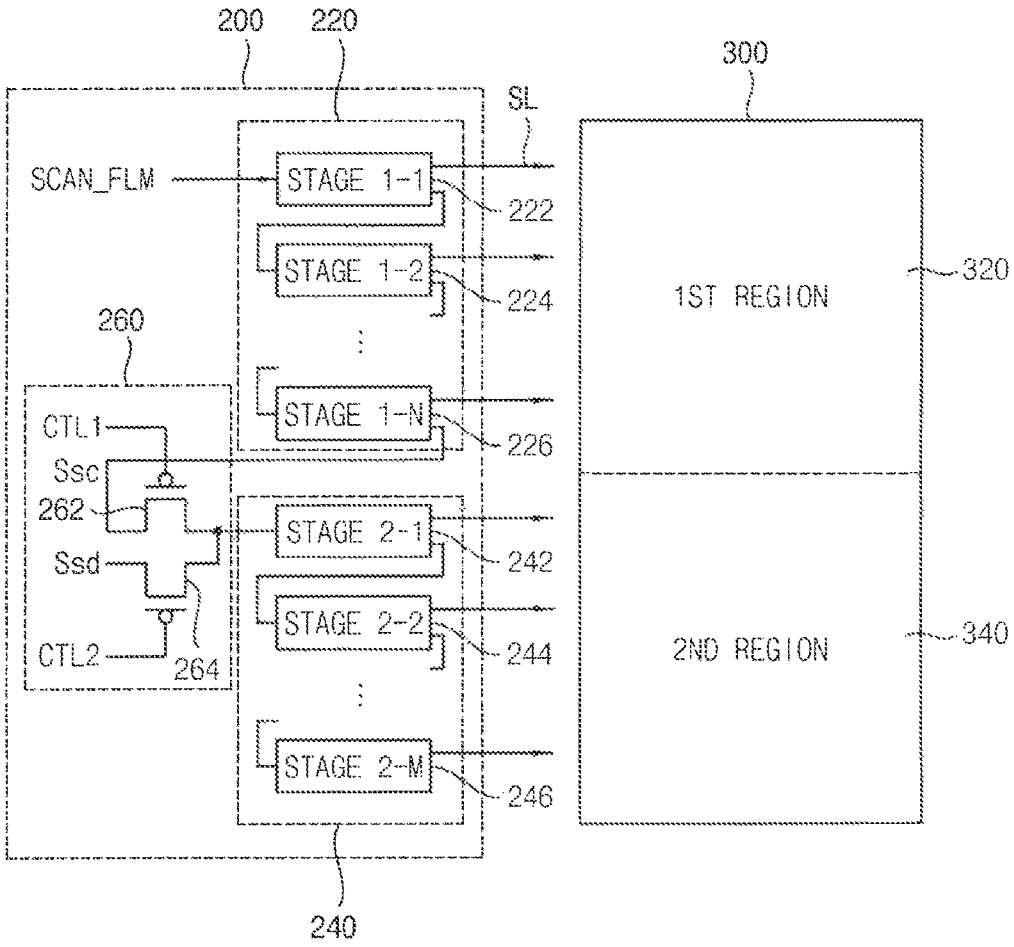
FIG. 2 is a diagram illustrating a scan driver included in the display device of FIG. 1.

FIG. 2 is a diagram illustrating a scan driver included in the display device of FIG. 1.

Referring to FIG. 2, the scan driver 200 includes first scan stages 220, second scan stages 240, and a scan switch 260. The first scan stages 220 can include STAGE 1-1, STAGE 1-2 . . . STAGE 1-N. The second scan stages 240 can include STAGE 2-1, STAGE 2-2 . . . STAGE 2-M. The scan driver 200 can include N of the first scan stages 220 and M of the second scan stages 240, where N and M are an integer greater than or equal to 1. The first scan stage 222 that provides a scan signal to the pixels in the first line of a first region 320 (that is, the STAGE 1-1) can generate the scan signal in response to a scan start signal SCAN_FLM provided from a timing controller or a data driver and can provide the scan signal to the pixels in the first line of the first region 320. Further, the first scan stage 222 that provides the scan signal to the pixels in the first line of the first region 320 (that is, the STAGE 1-1) can generate a scan carry signal Ssc and can provide the scan carry signal Ssc to the first scan stage 224 that provides the scan signal to the pixels in the second line of the first region 320 (that is, the STAGE 1-2). The first scan stages 220 can sequentially provide the scan signal to the pixels in the first region 320 through a scan line SL. The scan carry signal Ssc generated in the first scan stage 226 that provides the scan signal to the pixels in the Nth line of the first region 320 (that is, the STAGE 1-N) can be provided to the scan switch 260.

The scan switch 260 can selectively provide the scan carry signal Ssc provided from the first scan stage 226 that provides the scan signal to the pixels in the Nth line of the first region 320 (that is, the STAGE 1-N) or a scan disable signal Ssd that halts the operation of the second scan stages 240 to the second scan stage 242 that provides the scan signal to the pixels in a first line of the second region 340 (that is, the STAGE 2-1) based on a driving mode. Here, the scan disable signal Ssd can be generated from an external device or a power device. The scan switch 260 can include a first switching transistor 262 turned on in response to a first control signal CTL1 and the second switching transistor 264 turned on in response to a second control signal CTL2. Although the first switching transistor 262 and the second switching transistor 264 implemented as the PMOS transistor are described in FIG. 2, the first switching transistor 262 and the second switching transistor 264 are not limited thereto. For example, the first switching transistor 262 and the second switching transistor 264 are implemented with NMOS transistors.

The first control signal CTL1 can be provided to the scan switch 260 when the display device is driven in a first driving mode (e.g. an image is displayed on the first region 320 and the second region 340 in the first driving mode). The scan switch 260 can provide the scan carry signal Ssc provided from the first scan stage 226 to the second scan stages 242 through the first switching transistor 262 turned on in response to the first control signal CTL1. The second scan stage 242 that provides the scan signal to the pixels in the first line of the second region 340 can generate the scan signal in response to the scan carry signal Ssc provided through the scan switch 260 and can provide the scan signal to the pixels in the first line of the second region 340. Further, the second scan stage 242 that provides the scan signal to the pixels in the first line of the second region 340 can generate the scan carry signal Ssc and can provide the scan carry signal Ssc to the second scan stage 244. The second scan stages 240 can sequentially provide the scan signal to the pixels in the second region 340 through the scan line SL.

The second control signal CTL2 can be provided to the scan switch 260 when the display device is driven in a second driving mode (e.g. the image is displayed on the first region 320 in the second driving mode). The scan switch 260 can provide the scan disable signal Ssd to the second scan stage 242 that provides the scan signal to the pixels in the first line of the second region 340 through the second switching transistor 264 turned on in response to the second control signal CTL2. Here, the scan disable signal Ssd can be a signal having a voltage level that halts an operation of the second scan stage 242. Thus, in some embodiments, the second scan stage 242 that provides the scan signal to the pixels in the first line of the second region 340 does not generate the scan signal and the scan carry signal Ssc. As described above, in some embodiments, the second scan stages 240 is not provide the scan signal to the pixels in the second region 340 when the display device is driven in the second driving mode. Thus, the power consumption of the display device can decrease.

Figure 3:
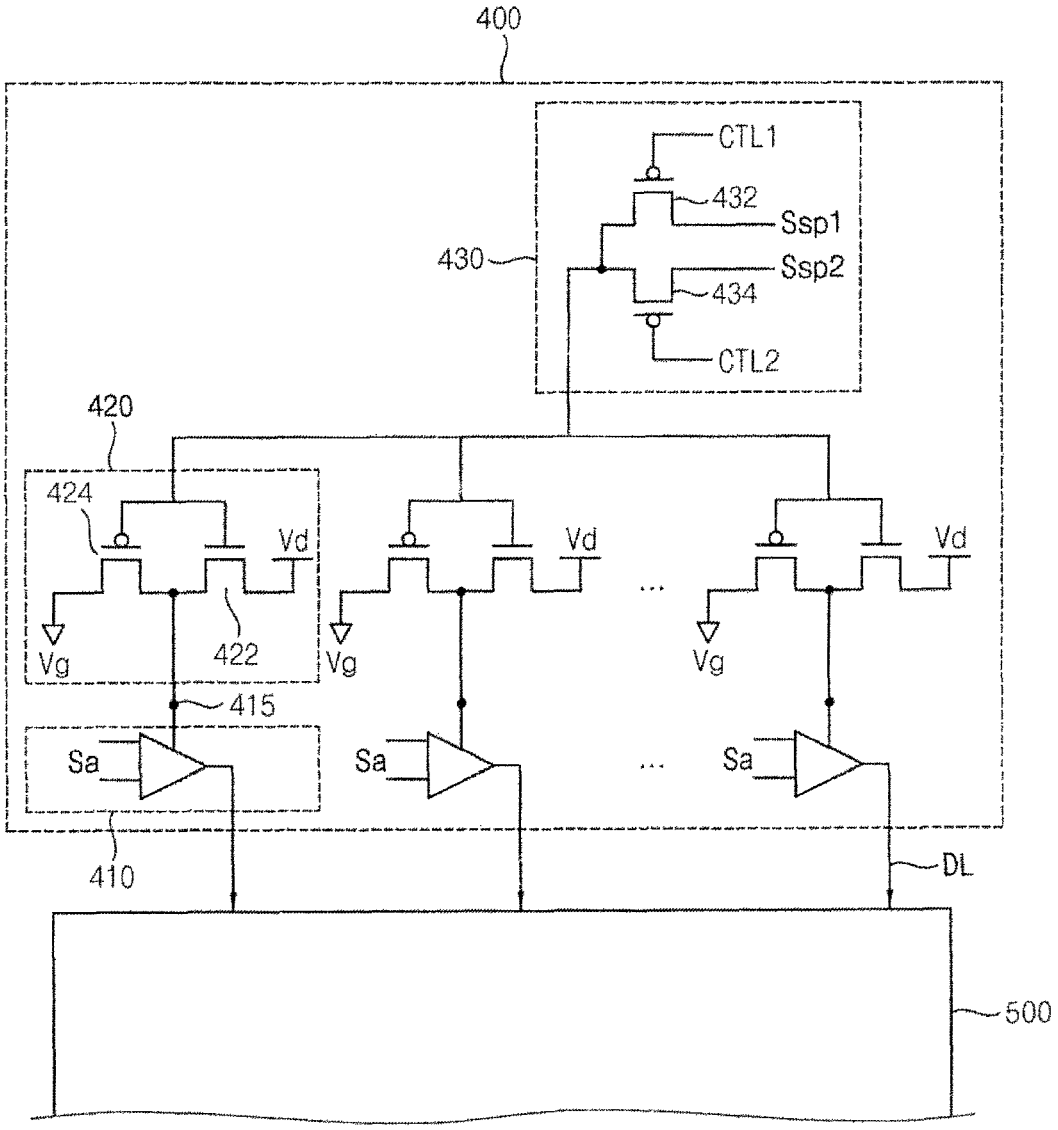
FIG. 3 is a diagram illustrating a data driver included in the display device of FIG. 1.
Figure 4A:
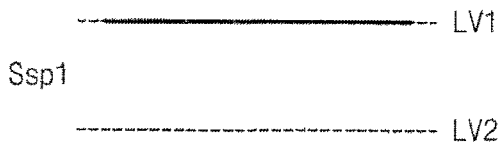
FIG. 4A is a diagram illustrating a first source power signal provided to the data driver of FIG. 3.
Figure 4B:
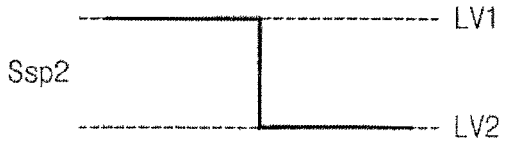
FIG. 4B is a diagram illustrating a second source power signal provided to the data driver of FIG. 3.

FIG. 3 is a diagram illustrating a data driver included in the display device of FIG. 1. FIG. 4A is a diagram illustrating a first source power signal provided to the data driver of FIG. 3. FIG. 4B is a diagram illustrating a second source power signal provided to the data driver of FIG. 3.

Referring to FIG. 3, the data driver 400 includes a source amplifier 410, a power switch 120 and a data switch 430.

The source amplifier 410 can amplify an input signal and output an amplified input data as a data signal. The data driver 440 can convert the input signal provided as a digital signal through the timing controller to the analog signal Sa and can output the data signal by amplifying the analog signal Sa using the source amplifier 410. The data signal can be provided to the display panel 500 through a data line DL. Here, the source amplifier can operate in response to a driving power Vd provided through the power switch 420.

The power switch 420 can determine whether to operate the source amplifier 410 by being coupled to a power terminal 415 of the source amplifier 410. The power switch 420 can selectively provide the driving power Vd or a ground power Vg to the source amplifier 410. The driving power Vd can be a power signal having a voltage level that operates the source amplifier 410. The ground power Vg can be a power signal having a voltage level that halts the operation of the source amplifier 410. The power switch 420 can include a first power switching transistor 422 turned on in response to a signal having a first voltage level and the second power switching transistor 424 turned on in response to a signal having a second voltage level. The driving power Vd can be provided to the source amplifier 410 when the first power switching transistor 422 turns on in response to the signal having the first voltage level. Then, the source amplifier 422 can operate. The ground power Vg can be provided to the source amplifier 410 when the second power switching transistor 424 turns on in response to the signal having the second voltage level. Then, in some embodiments, the source amplifier 422 does not operate. Although the first power switching transistor 422 implemented as the NMOS transistor and the second power switching transistor 424 implemented as the PMOS transistor are described in FIG. 3, the first power switching transistor 422 and the second power switching transistor 424 are not limited thereto. For example, the first power switching transistor is implemented as the PMOS transistor and the second power switching transistor 424 is implemented as the NMOS transistor.

The data switch 430 can selectively provide a first source power signal Ssp1 or a second source power signal Ssp2 to the power switch 420 based on the driving mode. Here, the first source power signal Ssp1 and the second source power signal Ssp2 can be generated from the external device or the power device. The data switch 430 can include a third switching transistor 432 turned on in response to the first control signal CTL1 and a fourth switching transistor 434 turned on in response to the second control signal CTL2. Although the third switching transistor 432 and the fourth switching transistor 434 implemented as the PMOS transistors are described, the third switching transistor 432 and the fourth switching transistor 434 are not limited thereto. For example, the third switching transistor 432 and the fourth switching transistor 434 are implemented as NMOS transistors. The first source power signal Ssp1 can be provided to the power switch 420 when the third switching transistor 432 turns on. The first source power signal Ssp1 can be a signal having the first voltage level LV1 as described in FIG. 4A. The second source power signal Ssp2 can be provided to the power switch 420 when the fourth switching transistor 434 turns on. The second source power signal Ssp2 can be a signal that changed from the first voltage level LV1 to the second voltage level LV2 as described in FIG. 4B.

The first control signal CTL1 can be provided to the data switch 430 from the timing controller when the display device is driven in the first driving mode (e.g. the image is displayed on the first region and the second region of the display panel 500 in the first driving mode). The data switch 430 can provide the first source power signal Ssp1 to the power switch 420 through the third switching transistor 432 turned on in response to the first control signal CTL1. The driving voltage Vd can be provided to the source amplifier 410 by turning on the first power switching transistor 422 because the first source power signal Ssp1 is the signal having the first voltage level LV1. The source amplifier 410 can amplify the analog signal Sa and output the amplified analog signal to the display panel 500 as the data signal through the data line DL by providing the driving power Vd to the source amplifier 410.

The second control signal CTL2 can be provided to the data switch 430 from the timing controller when the display device is driven in the second driving mode (e.g. the image is displayed on the first region in the second driving mode). The data switch 430 can provide the second source power signal Ssp2 to the power switch 420 through the fourth switching transistor 434 that turns on in response to the second control signal CTL2. The second source power signal can be the signal that changes from the first voltage level LV1 to the second voltage level LV2. The driving power Vd can be provided to the source amplifier 410 through the first power switching transistor 422 that turns on while the second source power signal Ssp2 has the first voltage level LV1. The ground power Vg can be provided to the source amplifier 410 through the second power switching transistor 424 turns on while the second source power signal Ssp2 has the second voltage level LV2. The source amplifier 410 can amplify the analog signal Sa and can output the amplified input signal as the data signal to the first region when the diving voltage Vd is provided to the source amplifier 410. In some embodiments, the source amplifier 410 does not operate and does not provide the data signal to the second region when the ground voltage Vg is provided to the source amplifier 410. Thus, the power consumption can decrease when the partial region of the display panel 500 is driven.

Figure 5:
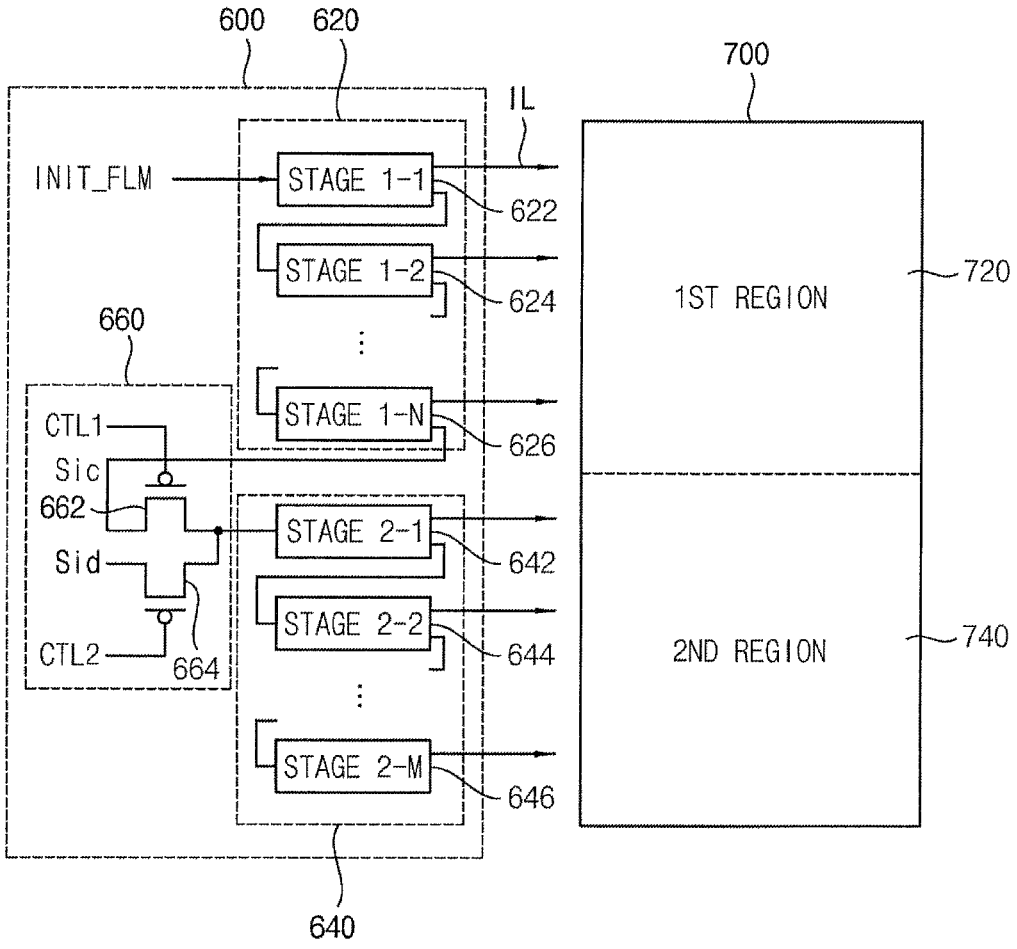
FIG. 5 is a diagram illustration an initial driver included in the display device of FIG. 1.

FIG. 5 is a diagram illustration an initial driver included in the display device of FIG. 1.

Referring to FIG. 5, the initial driver 600 includes first initial stages 620, second initial stages 640, and an initial switch 660. The first initial stages 620 can include STAGE 1-1, STAGE 1-2 . . . STAGE 1-N. The second initial stages 640 can include STAGE 2-1, STAGE 2-2 . . . STAGE 2-M. The initial driver 600 can include N of the first initial stages 620 and M of the second initial stages 640, where N and M are an integer greater than or equal to 1. The first initial stage 622 that provides an initial signal to the pixels in a first line of a first region 720 (that is, the STAGE 1-1) can generate the initial signal in response to an initial start signal INIT_FLM provided from a timing controller or a data driver and can provide the initial signal to the pixels in the first line of the first region 720 through an initial line IL. Further, the first initial stage 622 that provides the initial signal to the pixels in the first line of the first region 720 (that is, the STAGE 1-1) can generate an initial carry signal Sic and can provide the initial carry signal Sic to the first initial stage 624 that provides the initial signal to the pixels in a second line of the first region 720 (that is, the STAGE 1-2). The first initial stages 620 can sequentially provide the initial signal to the pixels in the first region 720 through the initial line IL. The initial carry signal Sic generated in the first initial stage 626 that provides the initial signal to the pixels in Nth line of the first region 720 (that is, the STAGE 1-N) can be provided to the initial switch 660.

The initial switch 660 can selectively provide the initial carry signal Sic provided from the first initial stage 626 that provides the initial signal to the pixels in the Nth line of the first region 720 (that is, the STAGE 1-N) or an initial disable signal Sid that halts the operation of the second initial stages 640 to the second initial stage 642 that provides the initial signal to the pixels in the first line of the second region 740 (that is, the STAGE 2-1) based on the driving mode. Here, the initial disable signal Sid can be generated from an external device or a power device. The initial switch 660 can include a first switching transistor 662 turned on in response to a first control signal CTL1 and the second switching transistor 664 turned on in response to a second control signal CTL2. Although the first switching transistor 662 and the second switching transistor 664 implemented as the PMOS transistor are described in FIG. 5, the first switching transistor 662 and the second switching transistor 664 are not limited thereto. For example, the first switching transistor 662 and the second switching transistor 664 can be implemented as the NMOS transistor.

The first control signal CRL 1 can be provided to the initial switch 660 when the display device is driven in the first driving mode (e.g. an image is displayed on the first region 720 and the second region 740 in the first driving mode). The initial switch 660 can provide the initial carry signal Sic provided from the first initial stage 626 that provides the initial signal to the pixels in the Nth line of the first region 720 to the second initial stages 642 that provides the initial signal to the pixels in the first line of the second region 740 through the first switching transistor 662 turned on in response to the first control signal CTL1. The second initial stage 642 that provides the initial signal to the pixels in the first line of the second region 740 can generate the initial signal in response to the initial carry signal Sic provided through the initial switch 660 and can provide the initial signal to the pixels in the first line of the second region 740. Further, the second initial stage 642 can generate the initial carry signal Sic and can provide the initial carry signal Sic to the second initial stage 644. The second initial stages 640 can sequentially provide the initial signal to the pixels in the second region 740 through the initial line IL.

The second control signal CTL2 can be provided to the initial switch 660 when the display device is driven in the second driving mode (e.g. the image is displayed on the first region 720 in the second driving mode). The initial switch 660 can provide the initial disable signal Sid to the second initial stage 642 that provides the initial signal to the pixels in the first line of the second region 740 through the second switching transistor 664 turned on in response to the second control signal CTL2. Here, the initial disable signal Sid can be a signal having the voltage level that halts the operation of the second initial stage 642. In some embodiments, the second initial stage 642 that provides the initial signal to the pixels in the first line of the second region 740 is not driven when the initial disable signal Sid is provided. Thus, in some embodiments, the second initial stage 642 does not generate the initial signal and the initial carry signal Sic. As described above, in some embodiments, the second stages 640 does not provide the initial signal to the pixels in the second region 740 when the display device is driven in the second driving mode. Therefore, the power consumption of the display device can decrease.

Figure 6:
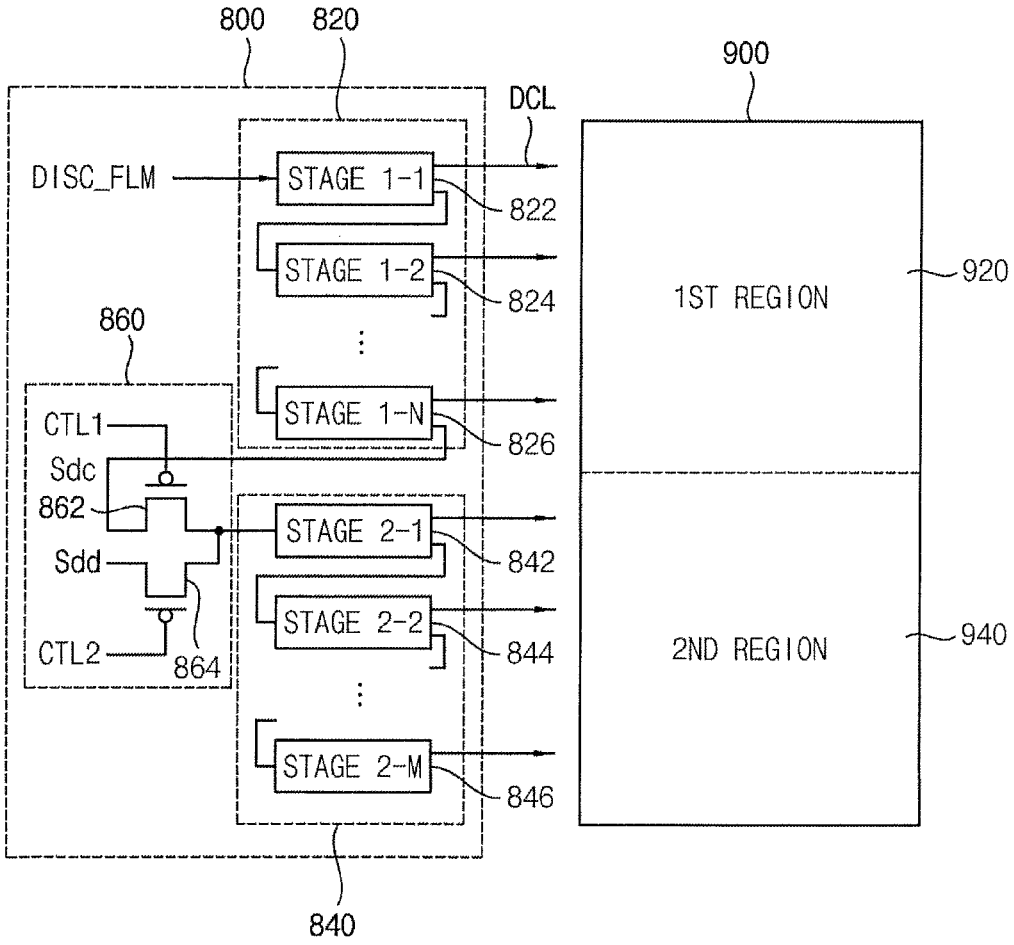
FIG. 6 is a diagram illustrating a discharge driver included in the display device of FIG. 1.

FIG. 6 is a diagram illustrating a discharge driver included in the display device of FIG. 1.

Referring to FIG. 6, the discharge driver includes first discharge stages 820, second discharge stages 840, and a discharge switch 860. The first discharge stages 820 can include STAGE 1-1, STAGE 1-2 . . . STAGE 1-N. The second discharge stages 840 can include STAGE 2-1, STAGE 2-2 . . . STAGE 2-M. The discharge driver 800 can include N of the first discharge stages 820 and M of the second discharge stages 840, where N and M are an integer greater than or equal to 1. The first discharge stage 822 that provides the discharge signal to the pixels in the first line of a first region 920 (that is, the STAGE 1-1) can generate the discharge signal in response to the discharge start signal DISC_FLM provided from a timing controller or a data driver and can provide the discharge signal to the pixels in the first line of the first region 920 through a discharge line DCL. Further, the first discharge stage 822 that provides the discharge signal to the pixels in the first line of the first region 920 (that is, the STAGE 1-1) can generate a discharge carry signal Sdc and can provide the discharge carry signal Sdc to the first discharge stage 824 that provides the discharge signal to the pixels in the second line of the first region 920 (that is, the STAGE 1-2). The first discharge stages 820 can sequentially provide the discharge signal to the pixels in the first region 920 through the discharge line DCL. The discharge carry signal Sdc generated in the first discharge stage 826 that provides the discharge signal to the pixels in the Nth line of the first region 920 (that is, the STAGE 1-N) can be provided to the discharge switch 860.

The discharge switch 860 can selectively provide the discharge carry signal Sdc provided from the first discharge stage 826 that provides the discharge signal to the pixels in the Nth line of the first region 920 (that is, the STAGE 1-N) or a discharge disable signal Sdd that halts the operation of the second discharge stages 840 to the second discharge stage 842 that provides the discharge signal to the pixels in the first line of the second region 940 (that is, the STAGE 2-1) based on the driving mode. Here, the discharge disable signal Sdd can be generated from an external device or a power device. The discharge switch 860 can include a first switching transistor 862 turned on in response to a first control signal CTL1 and a second switching transistor 864 turned on in response to a second control signal CTL2. Although the first switching transistor 862 and the second switching transistor 864 implemented as the PMOS transistor are described, the first switching transistor 862 and the second switching transistor 864 are not limited thereto. For example, the first switching transistor 862 and the second switching transistor 864 can be implemented as the NMOS transistor.

The first control signal CTL1 can be provided to the discharge switch 860 when the display device is driven in the first driving mode (e.g. an image is displayed on the first region 920 and the second region 940 in the first driving mode). The discharge switch 860 can provide the discharge carry signal Sdc provided from the first discharge stage 826 that provides the discharge signal to the pixels in the Nth line of the first region 920 to the second discharge stage 842 that provides the discharge signal to the pixels in the first line of the second region 940 through the first switching transistor turned on in response to the first control signal CTL1. The second discharge stage 842 that provides the discharge signal to the pixels in the first line of the second region 940 can generate the discharge signal in response to the discharge carry signal Sdc provided through the discharge switch 860 and can provide the discharge signal to the pixels in the first line of the second region 940. Further, the second discharge stage 842 can generate the discharge carry signal Sdc and can provide the discharge carry signal Sdc to the second stage 844. The second discharge stages 840 can sequentially provide the discharge signal to the pixels in the second region 940 through the discharge line DCL.

The second control signal CTL2 can be provided to the discharge switch 860 when the display device is driven in the second driving mode (e.g. the image is displayed on the first region 920 in the second driving mode). The discharge switch 860 can provide the discharge disable signal Sdd to the second discharge stage 642 that provides the discharge signal to the pixels in the first line of the second region 940 through the second switching transistor 864 turned on in response to the second control signal CTL2. Here, the discharge disable signal Sdd can be a signal having a voltage level that halts the operation of the second discharge stage 842. In some embodiments, the second discharge stage 842 is not driven when the discharge disable signal Sdd is provided through the discharge switch 860. Thus, in some embodiments, the second discharge stage 842 does not generate the discharge signal and the discharge carry signal Sdc. As described above, in some embodiments, the second discharge stages 840 does not provide the discharge signal to the pixels in the second region 940 when the display device is driven in the second mode. Therefore, the power consumption of the display device can decrease.

Figure 7:
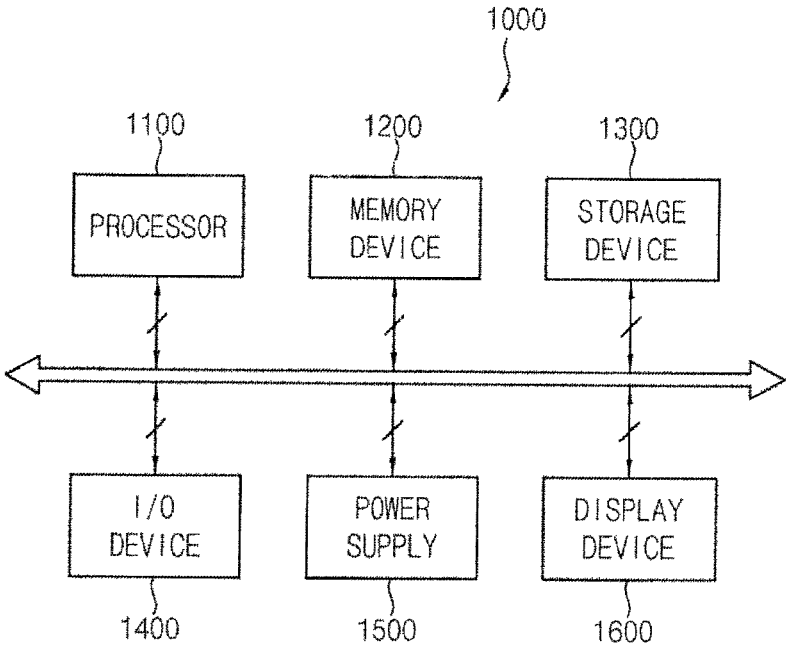
FIG. 7 is a block diagram illustrating an electronic device according to example embodiments.
Figure 8:
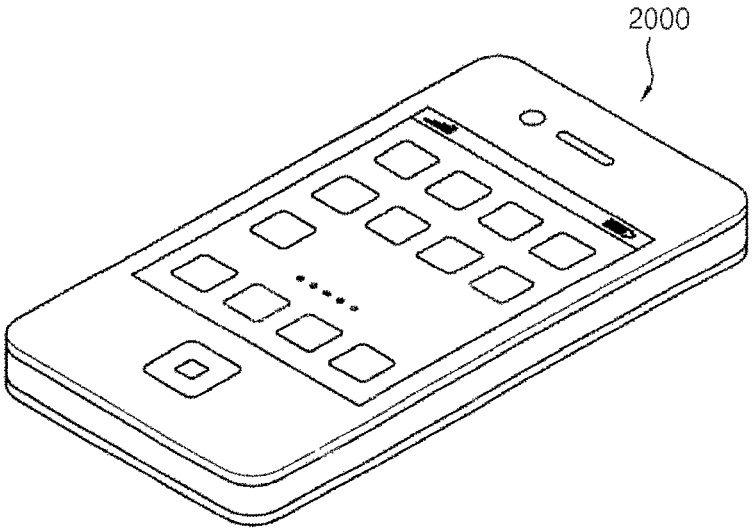
FIG. 8 is a diagram illustrating an example embodiment in which the electronic device of FIG. 7 is implemented as a smartphone.

FIG. 7 is a block diagram illustrating an electronic device according to example embodiments. FIG. 8 is a diagram illustrating an example embodiment in which the electronic device of FIG. 7 is implemented as a smartphone.

Referring to FIGS. 7 and 8, the electronic device 1000 includes a processor 1100, a memory device 1200, a storage device 1300, an input/output (I/O) device 1400, a power device 1500, and a display device 1600. Here, the display device 1600 can correspond to the display device 100 of FIG. 1. In addition, the electronic device 1000 can further include a plurality of ports for communicating a video card, a sound card, a memory card, a universal serial bus (USB) device, other electronic devices, etc. Although it is illustrates in FIG. 6 that the electronic device 1000 is implemented as a smartphone 800, a kind of the electronic device 1000 is not limited thereto.

The processor 1100 can perform various computing functions. The processor 1100 can be a microprocessor, a central processing unit (CPU), etc. The processor 1100 can be coupled to other components via an address bus, a control bus, a data bus, etc. Further, the processor 1100 can be coupled to an extended bus such as peripheral component interconnect (PCI) bus. The memory device 1200 can store data for operations of the electronic device 1000. For example, the memory device 1200 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 1300 can be a solid state drive (SSD) device, a hard disk drive (HDD) device, a CD-ROM device, etc.

The I/O device 1400 can be an input device such as a keyboard, a keypad, a touchpad, a touch-screen, a mouse, etc., and an output device such as a printer, a speaker, etc. In some example embodiments, the display device 1600 is included in the I/O device 1400. The power device 1500 can provide power for operations of the electronic device 1000. The display device 1600 can communicate with other components via the busses or other communication links.

As described above, the electronic device of FIG. 7 that includes the display device 1600 can decrease the power consumption by providing the scan signal, the data signal, the initial signal, and the discharge signal to the partial region of the display panel based on the driving mode. In some embodiments, the display device 1600 does not provide the scan signal, the data signal, the initial signal, and the discharge signal by including the switching unit in each of the scan driver, the data driver, the initial driver, and the discharge driver and controlling the switching unit. Thus, the electronic device 1000 that includes the display panel 1600 can decrease the power consumption.

The described technology can be applied to a display device and an electronic device having the display device. For example, the described technology can be applied to computer monitors, laptop computers, digital cameras, cellular phones, smartphones, smart pads, televisions, personal digital assistants (PDAs), portable multimedia players (PMPs), MP3 players, navigation systems, game consoles, video phones, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel including a plurality of pixels, wherein the display panel is divided into first and second regions;

a scan driver including i) a plurality of first scan stages configured to sequentially provide a scan signal to the pixels in the first region, ii) a plurality of second scan stages configured to sequentially provide the scan signal to the pixels in the second region, and iii) a scan switch connected between a last one of the first scan stages and a first one of the second scan stages, wherein the last one of the first scan stages is configured to provide a scan carry signal to the scan switch, wherein immediately adjacent ones of the first scan stages are directly connected to each other without a scan switch therebetween, wherein immediately adjacent ones of the second stages are directly connected to each other without a scan switch therebetween, wherein the scan switch is configured to selectively provide the scan carry signal or a scan disable signal to the first one of the second scan stages, and wherein the scan disable signal is configured to halt the operation of the second scan stages;

a data driver configured to provide a data signal to the pixels; and a timing controller configured to generate first and second control signals configured to respectively control the scan driver and the data driver, wherein the scan switch is configured to provide the scan carry signal to selected one of the second scan stages in a first driving mode and the scan disable signal to the selected second scan stage in a second driving mode, wherein the scan switch includes a first switching transistor and a second switching transistor, and wherein the scan switch is configured to provide the scan disable signal to the selected second scan stage when the second switching transistor is turned on.

2. The display device of claim 1, wherein the first switching transistor is turned on based on the first control signal; and wherein the second switching transistor is turned on based on the second control signal.

3. The display device of claim 2, wherein the scan switch is configured to provide the scan carry signal to the selected second scan stage when the first switching transistor is turned on.

4. The display device of claim 2, wherein the data driver includes:

at least one source amplifier configured to amplify an input signal and output the amplified input signal as the data signal, wherein the at least one source amplifier includes a power terminal;

at least one power switch configured to selectively provide driving power or ground power to the power terminal of the at least one source amplifier; and a data switch configured to provide i) a predetermined first source power signal to the power switch in the first driving mode and ii) a predetermined second source power signal to the power switch in the second driving mode.

5. The display device of claim 4, wherein the data switch includes:

a third switching transistor configured to be turned on based on the first control signal; and a fourth switching transistor configured to be turned on based on the second control signal.

6. The display device of claim 5, wherein the data switch is configured to provide the first source power signal having a first voltage level to the power switch when the third switching transistor is turned on, and wherein the data switch is further configured to change the second source power signal from the first voltage level to a second voltage level different from the first voltage level when the fourth switching transistor is turned on.

7. The display device of claim 4, wherein the power switch includes:

a first power switching transistor configured to provide the driving power to the power terminal of the source amplifier based on the first control signal having a first voltage level; and a second power switching transistor configured to provide the ground power to the power terminal of the source amplifier based on the second control signal having a second voltage level different from the first voltage level.

8. The display device of claim 1, wherein each pixel includes a driving transistor, and wherein the display device further comprises an initial driver including:

a plurality of first initial stages configured to sequentially provide an initial signal to initialize a gate voltage of the driving transistor of a first pixel in the first region;

a plurality of second initial stages configured to sequentially provide the initial signal to the pixels in the second region; and an initial switch connected between the first and second initial stages, wherein one of the first initial stages is configured to provide an initial carry signal to the initial switch, wherein the initial switch is configured to selectively provide the initial carry signal or an initial disable signal to the second initial stages, and wherein the initial disable signal is configured to halt the operation of the second initial stages.

9. The display device of claim 1, wherein each pixel includes an organic light-emitting element, and wherein the display device further comprises a discharge driver including;

a plurality of first discharge stages configured to sequentially provide a discharge signal to form a discharge path of the organic light-emitting element of a pixel in the first region;

a plurality of second discharge stages configured to sequentially provide the discharge signal to the pixels in the second region; and a discharge switch connected between the first and second discharge stages, wherein one of the first discharge stages is configured to provide a discharge carry signal to the discharge switch, wherein the discharge switch is configured to selectively provide the discharge carry signal or a discharge disable signal to the second discharge stages, and wherein the discharge disable signal is configured to halt the operation of the second discharge stages.

10. An electronic device, comprising:

a display device; and a processor configured to control the display device, wherein the display device includes:

a display panel including a plurality of pixels, wherein the display panel is divided into first and second regions;

a scan driver including i) a plurality of first scan stages configured to sequentially provide a scan signal to the pixels in the first region, ii) a plurality of second scan stages configured to sequentially provide the scan signal to the pixels in the second region, and iii) a scan switch connected between a last one of the first scan stages and a first one of the second scan stages, wherein the last one of the first scan stages is configured to provide a scan carry signal to the scan switch, wherein immediately adjacent ones of the first scan stages are directly connected to each other without a scan switch therebetween, wherein immediately adjacent ones of the second stages are directly connected to each other without a scan switch therebetween, wherein the scan switch is configured to selectively provide the scan carry signal or a scan disable signal to the first one of the second scan stages, and wherein the scan disable signal is configured to halt the operation of the second scan stages;

a data driver configured to provide a data signal to the pixels; and a timing controller configured to generate first and second control signals configured to respectively control the scan driver and the data driver, wherein the scan switch is configured to provide the scan carry signal to a selected one of the second scan stages in a first driving mode and the scan disable signal to the selected second scan stage in a second driving mode, wherein the scan switch includes a first switching transistor and a second switching transistor, and wherein the scan switch is configured to provide the scan disable signal to the selected second scan stage when the second switching transistor is turned on.

11. The electronic device of claim 10, wherein the first switching transistor is turned on based on the first control signal; and wherein the second switching transistor is turned on based on the second control signal.

12. The electronic device of claim 11, wherein the scan switch is configured to provide the scan carry signal to the selected second scan stage when the first switching transistor is turned on.

13. The electronic device of claim 11, wherein the data driver includes:

at least one source amplifier configured to amplify an input signal and output the amplified input signal as the data signal, wherein the at least one source amplifier includes a power terminal;

at least one power switch configured to selectively provide driving power or ground power to the power terminal of the at least one source amplifier; and a data switch configured to provide i) a predetermined first source power signal to the power switch in the first driving mode and ii) a predetermined second source power signal to the power switch in the second driving mode.

14. The electronic device of claim 13, wherein the data switch includes:

a third switching transistor configured to be turned on based on the first control signal; and a fourth switching transistor configured to be turned on based on the second control signal.

15. The electronic device of claim 14, wherein the data switch is configured to provide the first source power signal having a first voltage level to the power switch when the third switching transistor is turned on, and wherein the data switch is further configured to change the second source power signal from the first voltage level to a second voltage level different from the first voltage level when the fourth switching transistor is turned on.

16. The electronic device of claim 13, wherein the power switch includes:

a first power switching transistor configured to provide the driving power to the power terminal of the source amplifier based on the first control signal having a first voltage level; and a second power switching transistor configured to provide the ground power to the power terminal of the source amplifier based on the second control signal having a second voltage level different from the first voltage level.

17. The electronic device of claim 10, wherein the display device further includes an initial driver comprising:

a plurality of first initial stages configured to sequentially provide an initial signal to initialize a gate voltage of a driving transistor of a first pixel in the first region;

a plurality of second initial stages configured to sequentially provide the initial signal to the pixels in the second region; and an initial switch connected between the first and second initial stages, wherein one of the first initial stages is configured to provide an initial carry signal to the initial switch, wherein the initial switch is configured to selectively provide the initial carry signal or an initial disable signal to the second initial stages, and wherein the initial disable signal is configured to halt the operation of the second initial stages.

18. The electronic device of claim 10, wherein the display device further includes a discharge driver comprising:

a plurality of first discharge stages configured to sequentially provide a discharge signal to form a discharge path of a organic light-emitting element of a pixel in the first region;

a plurality of second discharge stages configured to sequentially provide the discharge signal to the pixels in the second region; and a discharge switch connected between the first and second discharge stages, wherein one of the first discharge stages is configured to provide a discharge carry signal to the discharge switch, wherein the discharge switch is configured to selectively provide the discharge carry signal or a discharge disable signal to the second discharge stages, and wherein the discharge disable signal is configured to halt the operation of the second discharge stages.

* * * * *